US005963173A

United States Patent [19]

Lian et al.

[11] Patent Number: 5,963,173

[45] Date of Patent: Oct. 5, 1999

[54] ANTENNA AND TRANSMITTER ARRANGEMENT FOR EAS SYSTEM

[75] Inventors: Ming-Ren Lian; Thomas P. Solaski, both of Boca Raton, Fla.

[73] Assignee: Sensormatic Electronics Corporation, Boca Raton, Fla.

[21] Appl. No.: 08/985,941

[22] Filed: Dec. 5, 1997

[51] Int. Cl.[6] ..... H01Q 11/12

[52] U.S. Cl. ..... 343/742; 343/867; 340/572

[58] Field of Search ..... 343/742, 741, 343/867, 788; 340/505, 572

[56] References Cited

U.S. PATENT DOCUMENTS

| | | | |
|---|---|---|---|
| 3,588,905 | 6/1971 | Dunlavy | 343/867 |
| 3,683,389 | 8/1972 | Hollis | 343/742 |
| 4,243,980 | 1/1981 | Lichtblau | 343/742 |
| 4,260,990 | 4/1981 | Lichtblau | 343/742 |
| 4,658,241 | 4/1987 | Torre | 340/551 |
| 4,675,658 | 6/1987 | Anderson et al. | 340/551 |
| 4,679,046 | 7/1987 | Curtis et al. | 343/867 |
| 5,023,600 | 6/1991 | Szklany et al. | 340/572 |
| 5,103,234 | 4/1992 | Watkins | 343/742 |
| 5,103,235 | 4/1992 | Clemens | 343/742 |
| 5,353,011 | 10/1994 | Wheeler et al. | 340/572 |
| 5,663,738 | 9/1997 | Mueller | 343/867 |

*Primary Examiner*—Don Wong
*Assistant Examiner*—Tan Ho
*Attorney, Agent, or Firm*—Quarles & Brady LLP

[57] ABSTRACT

An antenna system for an electronic article surveillance system, comprising: a first, tunable transmitting loop; a second, tunable transmitting loop, the first and second transmitting loops being arranged for first and second modes of operation, the transmitting loops being field-coupled to one another such that tuning the antenna system for one of the modes of operation detunes the antenna system for the other mode of operation; a tunable compensation coil field-coupled to each of the first and second transmitting loops, the tunable compensation coil enabling the antenna system to be tuned for operation in one of the modes at a first resonant frequency, and despite the detuning, enabling the antenna system to be tuned for operation in the other of the modes at a second resonant frequency independently of the tuning for the first mode of operation. The first and second resonant frequencies can be the same as or different from one another. One of the first and second modes of operation is as an in-phase rectangular loop and the other of the first and second modes of operation is as a "figure-8". The compensation loop encircles the first and second transmitting loops.

19 Claims, 4 Drawing Sheets

ANTENNA AND TRANSMITTER ARRANGEMENT FOR EAS SYSTEM

BACKGROUND OF THE INVENTION

1. Field of the Invention

This invention relates to the field of electronic article surveillance systems, and in particular, to optimizing transmitter to antenna coupling for interlaced transmitter phases.

2. Description of Related Art

Electronic article surveillance (EAS) systems employ magnetic markers, also referred to as tags, which are placed on articles or products which are monitored to prevent unauthorized removal from a restricted space, for example a retail store or a library. Egress from the space is restricted to a lane or path into which a radio frequency interrogating signal is transmitted. This area is referred to as the interrogation zone. If the marker or tag is present in or on the article, and the marker or tag has not been deactivated, the marker or tag acts as a transponder and generates a return signal which can be identified by a receiver. The receiver can initiate an audible alarm, for example, or trigger other protective measures.

The transmitting and receiving antennas, often referred to as the transmitter/receiver pair, are mounted in floors, walls, ceilings or free standing pylons. These are necessarily fixed mounting positions. The articles, on the other hand, may be carried through the field of the interrogating signal in any orientation, and accordingly, so may the tags or markers.

The two most common antenna configurations are a rectangular loop and a "figure-8". These are implemented by using two adjacent rectangular loops, as shown in FIGS. 5(*a*) and 5(*b*). In FIG. 5(*a*) a pylon structure P has an upstanding portion on which two rectangular transmitting loops A and B are mounted with adjacent legs at height h above the floor. When the loops are driven by current flowing in the same direction, for example clockwise as indicated by arrows $I_A$ and $I_B$ in FIG. 5(*a*), the current D in the bottom leg of loop A and the current E in the top leg of loop B flow in opposite directions. Accordingly, the respective fields generated by currents D and E mostly cancel out one another. The overall effect is that of a single, large rectangular loop. This is referred to as an in-phase mode of operation. When the loops are driven by current flowing in opposite directions, as indicated by arrows $I_A$ and $I_B$ in FIG. 5(*b*), the current D in the bottom leg of loop A and the current E in the top leg of loop B flow in the same direction. Accordingly, the respective fields generated by currents D and E reinforce one another. The overall effect is that of a single, large "figure-8" loop. This is referred to as a "figure-8" or out-of-phase mode of operation. It will be appreciated that the two loop configurations can have shapes other than strictly rectangular, for example oval.

A single rectangular loop transmitter, the in-phase configuration, will provide substantial horizontal magnetic field, but a significantly lower or even zero valued vertical component, especially at the central height h of the interrogation zone. On the other hand, if a "figure 8" transmitter configuration is used, the vertical magnetic field becomes stronger but the horizontal component becomes weaker or even zero valued. Therefore it is desirable to interlace the transmitter phases, that is, alternate transmissions from the two antenna configurations, to maximize the system performance for all orientations of markers in the interrogation zone.

However, driving two transmitter loops in both the in-phase and figure-8 configurations requires different resonant capacitors to achieve the proper resonant conditions for each of the two modes. There is a significant difference in the resonant frequency, normally about 3 kHz, between the two antenna phases. When the transmitter is off-resonant, not enough current can be injected into the transmitter as is required for proper system detection.

An ULTRA MAX® marker or tag is the kind of tag having two components. One component is an amorphous material which responds to an interrogating signal at a resonant frequency, for example 58 KHz, in the presence of a magnetic bias. The other component is a magnetic material which provides the magnetic bias making possible the resonant response of the amorphous material. As may be expected, there is a distribution of manufactured marker frequencies due to process and material fluctuation. The marker frequency also varies with magnetic field. The resonant frequency of a linear ULTRA MAX® marker can shift up or down by about three to four hundred Hz in the vertical orientation due to the earth's magnetic field. The term ULTRA MAX® is a registered trademark of Sensormatic Electronics Corporation. Therefore, it is also desirable to transmit two frequencies, instead of one frequency, to increase the effective peak performance of the marker. The additional frequencies chosen are typically about two to three hundred Hz from the center operating frequency. Consequently, the transmitter of such a dual frequency system can not be optimized.

Accordingly, there has been a long felt need to provide an interlaced, dual frequency EAS system which can be optimized for peak performance and reliability.

SUMMARY OF THE INVENTION

An interlaced, dual frequency EAS system which can be optimized for peak performance and reliability in accordance with the inventive arrangements satisfies this long felt need. A novel transmitter antenna design allows for maximum coverage of an interlaced, dual frequency EAS system for all marker orientations.

In accordance with the inventive arrangements, a single loop with capacitor is added to the outer perimeter of the transmitter pair. During the "figure-8" operation mode, such an added loop does not influence the transmitter, due to a net zero coupling between the added loop and the "figure 8" transmitter configuration. In the in-phase mode, however, the added loop has a significant coupling with the transmitter pair. As a result, the in-phase tuning condition can be obtained by adjusting the capacitor in the added loop. The tuning frequencies of the two modes can be independently set.

For some applications, where the markers experience a larger frequency shift, it is advantageous to set the frequencies to be separated by about two to three hundred Hz from the center operational frequency. With such an implementation, the EAS system performance is not subject to fluctuation due to production variation and like factors.

An EAS system can be driven in either an in-phase or "figure-8" mode with proper tuning for maximum transmitter current. As a result, the system pick performance can be enhanced significantly.

An antenna system for an electronic article surveillance system, in accordance with an inventive arrangement, comprises: a first, tunable transmitting loop; a second, tunable transmitting loop, the first and second transmitting loops being arranged for first and second modes of operation, the transmitting loops being field-coupled to one another such that tuning the antenna system for one of the modes of operation detunes the antenna system for the other mode of operation; and, a tunable compensation coil field-coupled to each of the first and second transmitting loops, the tunable compensation coil enabling the antenna system to be tuned for operation in one of the modes at a first resonant frequency, and despite the detuning, enabling the antenna system to be tuned for operation in the other of the modes at a second resonant frequency independently of the tuning for the first mode of operation.

One of the first and second modes of operation is as an in-phase rectangular loop and the other of the first and second modes of operation is as a "figure-8".

The compensation coil encircles the first and second transmitting loops.

The system can further comprise means for supplying respective signals for energizing the first and second transmitting loops at said first and second resonant frequencies and in an interlaced manner.

A method for tuning an antenna system for an electronic article surveillance system in accordance with another inventive arrangement, the antenna system having first and second transmitting loops field-coupled to one another, comprises the steps of: field-coupling a compensation coil to each of the first and second transmitting loops; tuning the first and second transmitting loops for a first mode of operation at a first resonant frequency; and, tuning the compensation coil for operation at a second resonant frequency which can be the same as or different from the first resonant frequency.

The method can further comprise the step of encircling the first and second transmitting loops with the compensation loop.

In a presently preferred embodiment, the method comprises the steps of: transmitting from a "figure-8" antenna configuration in one of the first and second modes of operation; and, transmitting from a rectangular loop antenna configuration in the other of the first and second modes of operation. In accordance with this embodiment, the method further comprises the steps of: firstly tuning the transmitting loops for operation is the "figure-8" antenna configuration; and, secondly tuning the compensation coil for operation in the rectangular loop antenna configuration.

Finally, the method further comprises the step of supplying respective signals for energizing the first and second transmitting loops at the first and second resonant frequencies in an interlaced manner.

DETAILED DESCRIPTION OF THE PREFERRED EMBODIMENTS

Figure 1:
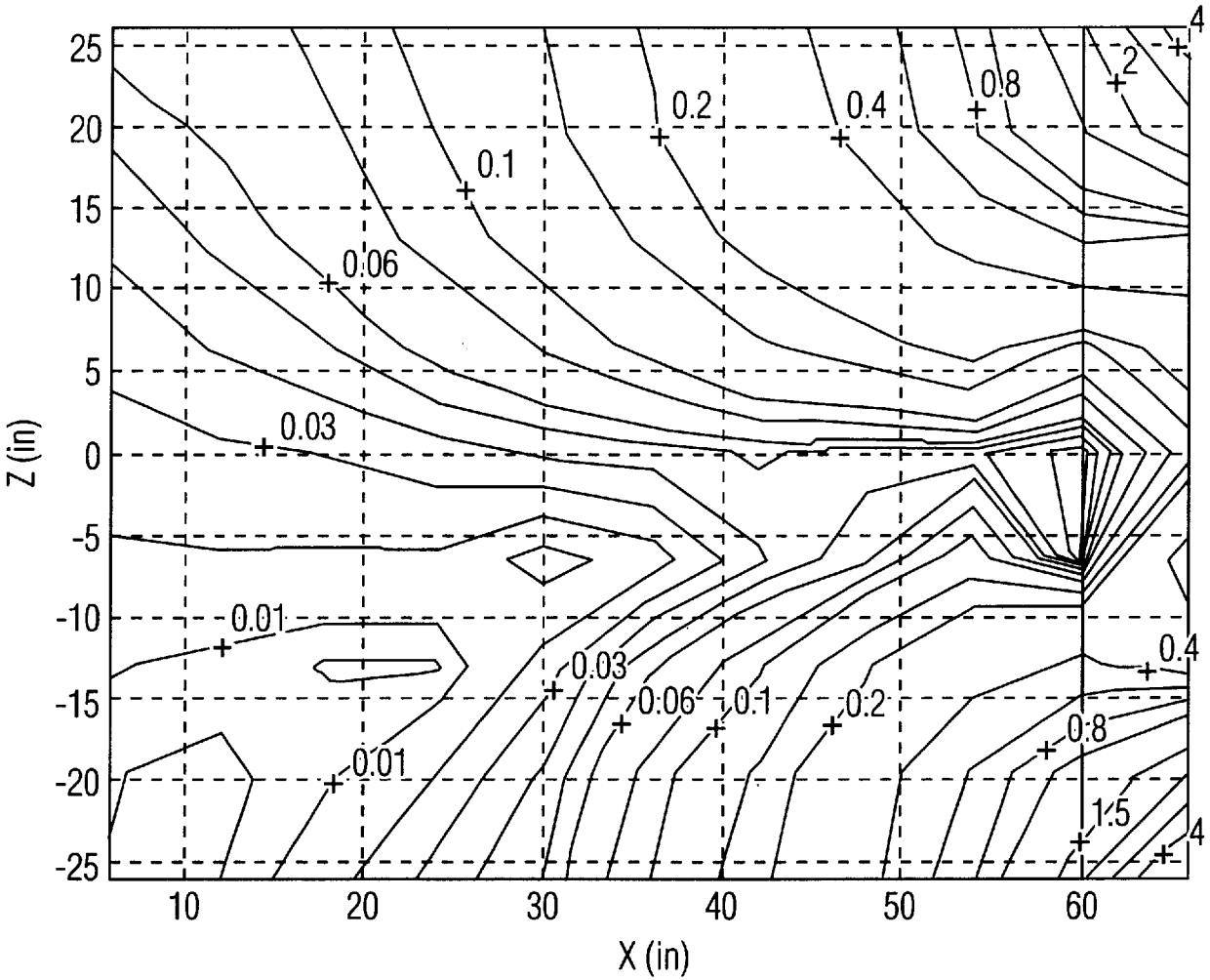
FIG. 1 is a plot useful for explaining the null characteristics of an in-phase transmitter loop.
Figure 2:
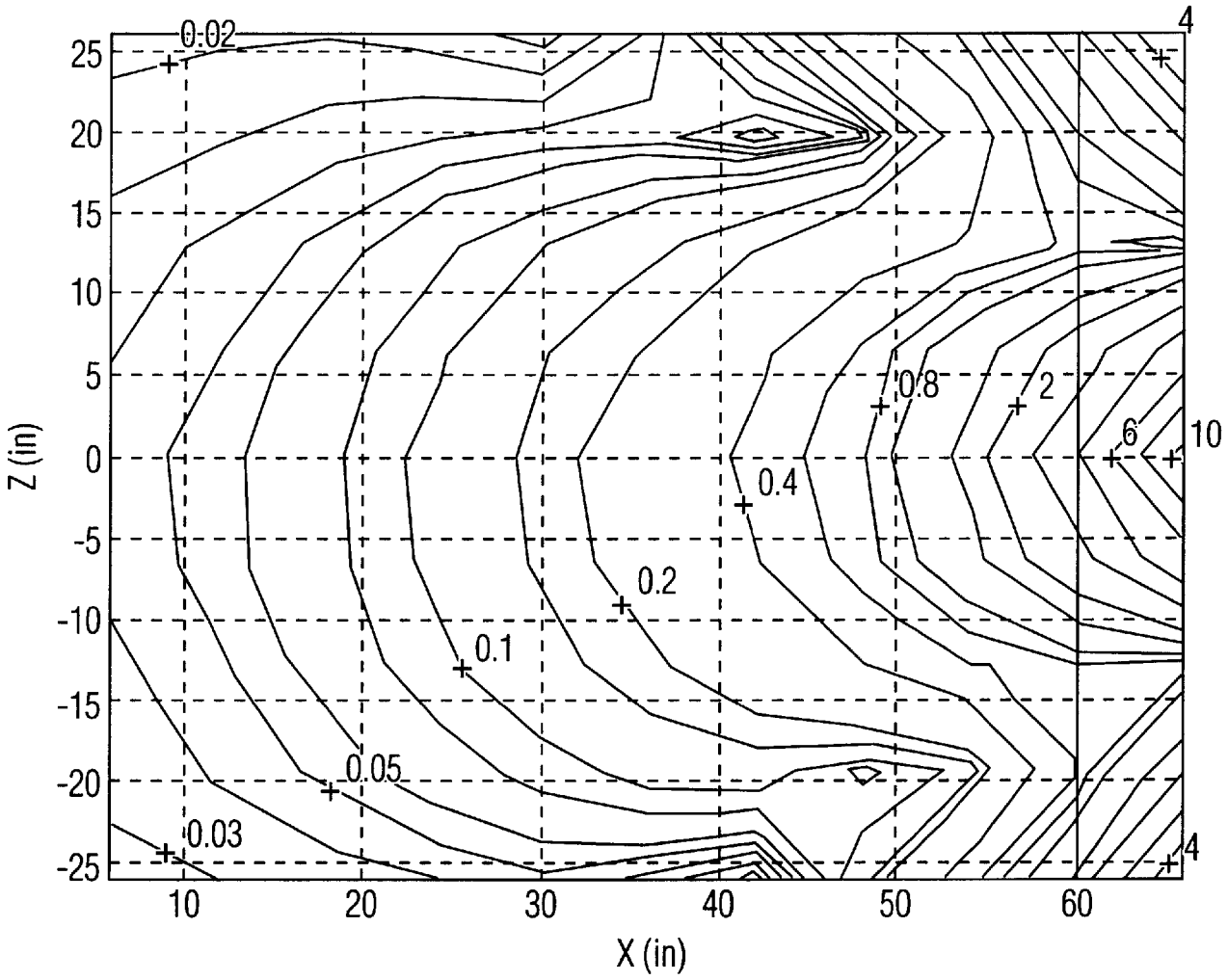
FIG. 2 is a plot useful for explaining the null characteristics of a "figure-8" transmitter loop.
Figure 4:
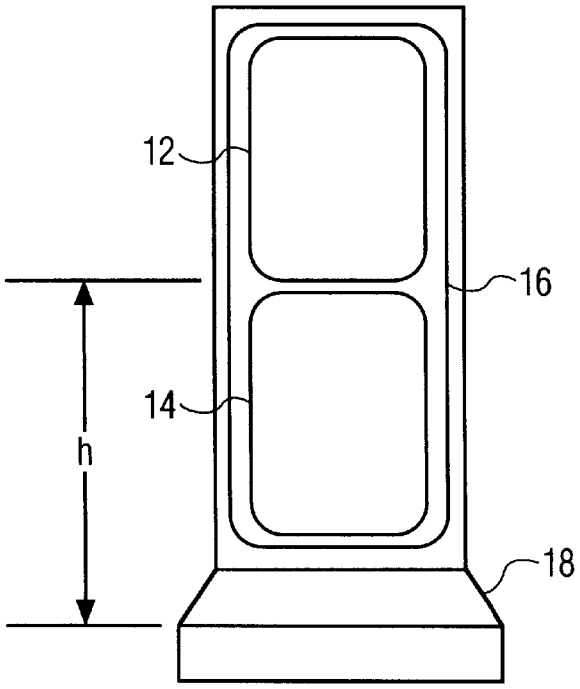
FIG. 4 is a front perspective view of an in-phase and "figure 8" transmitter loop configuration as mounted in a pylon, together with a compensation coil in accordance with the inventive arrangements.
Figure 5A:
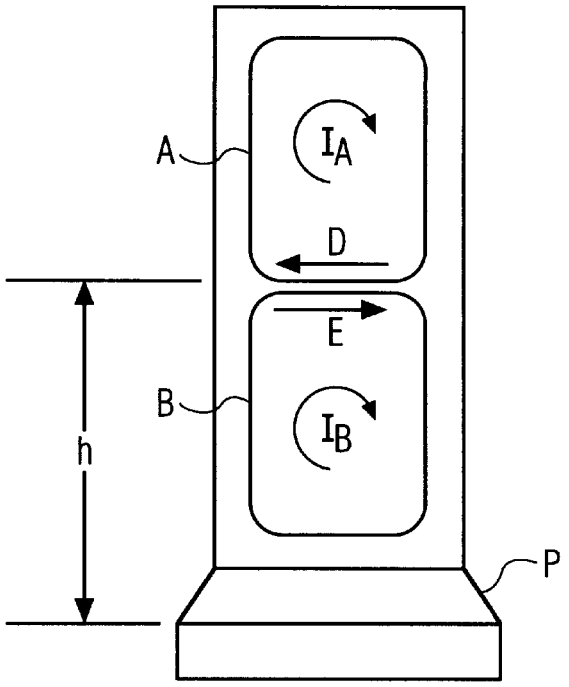
FIGS. 5(*a*) and 5(*b*) are front perspective views of a transmitter loop arrangement, as mounted in a pylon, for in-phase and "figure-8" modes of operation.
Figure 5B:
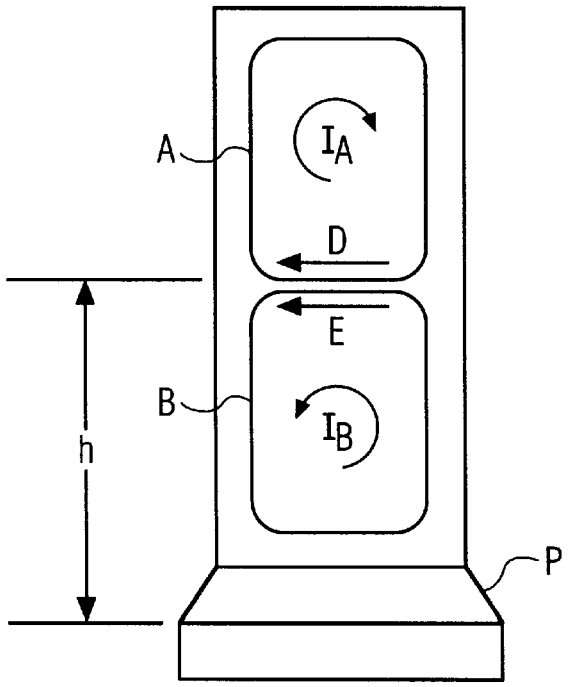

The directional properties of two component resonant tags or markers, for example an ULTRAMAX® marker, together with the physical limitations of a fixed antenna configuration in generating an oriented magnetic field, results in system null zones of the magnetic field in the interrogation zone in which the marker will not be detected. One solution to this predicament is to have two or more coils operated at different phases, such as in-phase or "figure-8", with respect to each other as shown by coils 12 and 14 in FIG. 4, which are mounted on a pylon or panel structure 18. FIG. 1 is a plot of vertical component field strength illustrating the coupling for the in-phase mode. In the in-phase mode, the two loops combined are essentially equivalent to a bigger loop, with a null at the central height h for vertical orientations. Due to the ground effect, the null zone bends down slightly as shown. FIG. 2 is a plot of vertical component field strength illustrating the coupling for the "figure-8" mode. The vertical coupling is maximum at the center height, while two weak spots exist at heights about 20 inches lower and higher than the central line, which is well covered by the in-phase components.

The transmitter must be tuned to provide sufficient current for proper operation. However, it has thus far been impossible to have the transmitter pair be in-tune for both in-phase and "figure-8" modes, due to existing mutual coupling of the two transmitter coils. The difference in resonant frequencies of the two transmitter phases typically ranges between 3 kHz to 4 kHz. Therefore, maximum transmitter efficiency could not be achieved for both phases.

In accordance with the inventive arrangements optimal tuning of the transmitter pair can be achieved regardless of the phasing configuration. The first step is to tune the "figure-8" mode to resonate at the designated operating frequency, for example 58 kHz. As a result, the resonant frequency of the in-phase mode shifts upwardly to 61.3 kHz. However, a compensation coil or loop 16, having one, two or a few turns can advantageously be wrapped around the outer perimeter of the pair of transmitter loops 12 and 14 and terminated with a capacitor. With a properly chosen capacitor value, the in-phase resonance can be adjusted back down to 58 kHz, due to the significant coupling between the compensation coil and the in-phase coil assemblies. The addition of the compensation loop does not affect the tuning of the "figure-8" mode because their mutual coupling is essentially zero. As a result, the modified coil assembly is tuned for both modes for maximum system detection.

Figure 3:
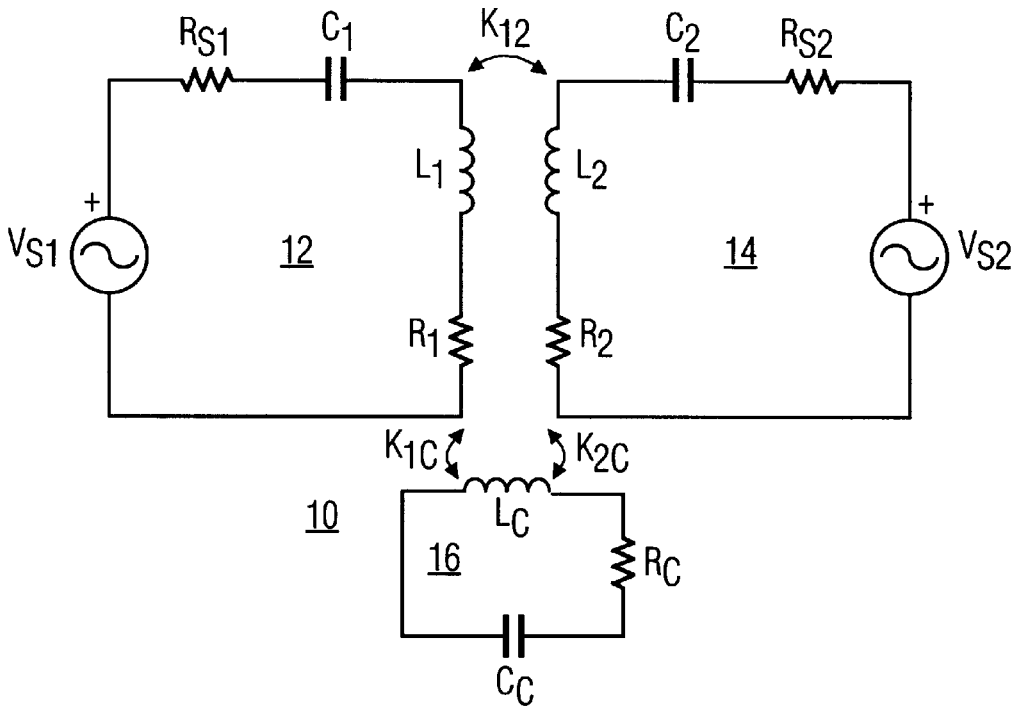
FIG. 3 is a circuit schematic showing a transmitter-antenna system according to the inventive arrangements.

An exemplary transmitter-antenna circuit 10 in accordance with the inventive arrangements is shown in FIG. 3. Inductors $L_1$ and $L_2$ represent the inductance of the two transmitter coils 12 and 14. Resistors $R_1$ and $R_2$, represent the respective series resistances of the transmitter coils 12 and 14. The capacitors $C_1$ and $C_2$ are used to tune the "figure-8" resonant frequency to the operating system frequency, for example 58 kHz. $V_{S1}$ and $R_{S1}$ represent the output voltage and internal source resistance for one of the antenna drivers. $V_{S2}$ and $R_{S2}$ represent the output voltage and internal source resistance for the other of the antenna drivers. The compensation loop or coil 16 needed for in-phase tuning is represented by inductor $L_c$, resistor $R_c$ and capacitor $C_c$. The coupling between the transmitter coils 12 and 14 is represented by $k_{12}$. The coupling between the compensation coil 16 and each of the transmitter coils 12 and 14 is represented by $k_{1C}$ and $k_{2C}$. Typical component values are shown in the following Tables.

TABLE 1

| Transmitter Loops | | | | |
|---|---|---|---|---|
| $R_{s1}$ | $L_1$ | $C_1$ | $R_1$ | $k_{12}$ |
| 1 Ω | 350 μH | 20 nF | 2.96 Ω | −0.053 |

TABLE 2

| Compensation Coil | | | |
|---|---|---|---|
| $L_c$ | $C_c$ | $R_c$ | $k_{1c,k2c}$ |
| 5.24 μH | 390 nF | 0.25 Ω | 0.39 |

It should be noted that the coupling between the stacked transmitter loops 12 and 14, even though as small as 0.053, is still large enough to cause trouble in maintaining the tuning condition for both modes without the compensation loop. The coupling between the transmitter and compensation loops is significantly higher. As a result, only a single compensation loop is enough for adequate frequency adjustment, or correction, for the in-phase condition.

When the antenna is in tune in the "figure-8" configuration, there is a significant difference in the circulating current with and without the compensation coil as shown in Table 3, when the antenna is driven in the in-phase configuration.

TABLE 3

| | $I_1$ (A) | $I_2$ (A) | $I_c$ (A) | Turns Ratio ($L_{1,2}/L_c$) |
|---|---|---|---|---|
| With compensation loop | 8 | 8 | 18 | 15:1 |
| Without compensation loop | 3.14 | 3.14 | N/A | 15:0 |

It can be seen that an improvement of the transmitter current of about 2.5 times in each coil is achieved with the addition of the compensation coil. Moreover, there is also a significant circulating current within the compensation coil, which also contributes to the magnetic field strength in the interrogation zone. Overall, the improvement is about 300% with the circuit parameters shown in FIG. 3.

What is claimed is:

1. An antenna system for an electronic article surveillance system, comprising:

a first, tunable transmitting loop;

a second, tunable transmitting loop, said first and second transmitting loops being arranged for first and second modes of operation, said transmitting loops being field-coupled to one another such that tuning said antenna system for one of said modes of operation detunes said antenna system for the other mode of operation; and, a tunable compensation coil field-coupled to each of said first and second transmitting loops, said tunable compensation coil enabling said antenna system to be tuned for operation in one of said modes at a first resonant frequency, and despite said detuning, enabling said antenna system to be tuned for operation in the other of said modes at a second resonant frequency independently of said tuning for said first mode of operation.

2. The antenna system of claim 1, wherein one of said first and second modes of operation of said first and second transmitting loops is an in-phase mode and the other of said first and second modes of operation of said first and second transmitting loops is an out-of-phase mode.

3. The antenna system of claim 2, wherein said compensation coil encircles said first and second transmitting loops.

4. The system of claim 3, further comprising means for supplying respective signals for energizing said first and second transmitting loops at said first and second resonant frequencies and in an interlaced manner.

5. The system of claim 2, further comprising means for supplying respective signals for energizing said first and second transmitting loops at said first and second resonant frequencies and in an interlaced manner.

6. The antenna system of claim 1, wherein said compensation coil encircles said first and second transmitting loops.

7. The system of claim 1, further comprising means for supplying respective signals for energizing said first and second transmitting loops at said first and second resonant frequencies and in an interlaced manner.

8. The system of claim 1, wherein said field coupled from said compensation coil to said first and second transmitting loops is substantially self-canceling in said one of said first and second modes of operation in which said antenna system is tuned to said first resonant frequency.

9. A method for tuning an antenna system for an electronic article surveillance system, having first and second transmitting loops the method comprising the steps of:

field-coupling first and second transmitting loops to one another;

field-coupling a compensation coil to each of said first and second transmitting loops;

tuning the first and second transmitting loops for a first mode of operation at a first resonant frequency; and, tuning said compensation coil for enabling operation of the first and second transmitting loops in a second mode of operation at a second resonant frequency different from said first resonant frequency, said tuning of the first and second transmitting loops in said first mode of operation being substantially independent of said tuning of said compensation coil.

10. The method of claim 9, comprising the step of encircling said first and second transmitting loops with said compensation coil.

11. The method of claim 9, comprising the steps of:

transmitting from an out-of-phase antenna configuration of the first and second transmitting loops in one of said first and second modes of operation; and, transmitting from an in-phase antenna configuration of the first and second transmitting loops in the other of said first and second modes of operation.

12. The method of claim 11, comprising the steps of:

firstly tuning said transmitting loops for operation in said out-of-phase antenna configuration; and, secondly tuning said compensation coil for operation of said transmitting loops in said in-phase antenna configuration.

13. The method of claim 12, further comprising the step of supplying respective signals for energizing said first and second transmitting loops at said first and second resonant frequencies in an interlaced manner.

14. The method of claim 11, further comprising the step of supplying respective signals for energizing said first and second transmitting loops at said first and second resonant frequencies in an interlaced manner.

15. The method of claim 9, further comprising the step of supplying respective signals for energizing said first and second transmitting loops at said first and second resonant frequencies in an interlaced manner.

16. The method of claim 9, further comprising the step of field-coupling said compensation coil to each of said first and second transmitting loops in a such a way that the field coupled from said compensation coil to the first and second transmitting loops is substantially self-canceling in one of said first and second modes of operation.

17. The method of claim 9, comprising the step of field-coupling said compensation coil so that the field coupled from said compensation coil to the first and second transmitting loops is substantially self-canceling in said one of said first and second modes of operation in which said first and second transmitting loops are tuned to said first resonant frequency.

18. A method for tuning an antenna system for an electronic article surveillance system, the antenna system having first and second transmitting loops field-coupled to one another, the method comprising the steps of:

field-coupling a compensation coil to each of said first and second transmitting loops in a such a way that the field coupled from said compensation coil to the first and second transmitting loops is substantially self-canceling in one of first and second modes of operation;

tuning the first and second transmitting loops to a first frequency in one of said first and second modes of operation; and, tuning said compensation coil to shift said first frequency to a different frequency in the other one of said first and second modes of operation.

19. The method of claim 18, comprising the step of field-coupling said compensation coil so that the field coupled from said compensation coil to the first and second transmitting loops is substantially self-canceling in said one of said first and second modes of operation in which said first and second transmitting loops are tuned to said first frequency.

* * * * *